US005551191A

United States Patent [19]

Maiwandi

[11] Patent Number: 5,551,191

[45] Date of Patent: Sep. 3, 1996

[54] LATCHING SKIMMER LID

[75] Inventor: Farid Maiwandi, Granada Hills, Calif.

[73] Assignee: KDI American Products Company, Moorpark, Calif.

[21] Appl. No.: 305,276

[22] Filed: Sep. 13, 1994

[51] Int. Cl.[6] ..... E05C 21/02

[52] U.S. Cl. ..... 49/465; 292/80

[58] Field of Search ..... 49/465, 463; 404/25, 404/26; 292/19, 20, 80, 87

[56] References Cited

U.S. PATENT DOCUMENTS

| | | | |
|---|---|---|---|
| 1,531,113 | 3/1925 | Lovejoy | 49/465 X |
| 2,009,132 | 7/1935 | Gehris | 49/465 |
| 2,089,371 | 8/1937 | Heller | 292/80 X |
| 2,535,275 | 12/1950 | Dixon | 49/465 |
| 3,616,956 | 11/1971 | Cooper | 49/465 X |
| 4,257,193 | 3/1981 | Williams | 49/465 |
| 4,761,319 | 8/1988 | Kraus et al. | 49/465 X |
| 5,100,015 | 3/1992 | Vanderstuyf | 292/87 X |

*Primary Examiner*—Philip C. Kannan
*Attorney, Agent, or Firm*—Noel F. Heal

[57] ABSTRACT

A removable lid for a pool skimmer, the lid including at least one, and preferably two, manually operated latches that prevent inadvertent removal of the lid and thereby eliminate a potentially hazardous condition posed by lids that can be removed by wind action, wave action, or by accidentally tripping on an incorrectly installed lid. Preferably, the lid has diametrically opposed latches, each having a bendable member with a camming surface that bends the latch to fit within a skimmer collar and then allows the latch to snap into a retaining position when the lid is completely installed. Access holes in the lid facilitate manual operation of the latches for removal of the lid for maintenance purposes.

4 Claims, 1 Drawing Sheet

LATCHING SKIMMER LID

BACKGROUND OF THE INVENTION

This invention relates generally to swimming pool and spa equipment and, more particularly, to pool skimmers. A pool skimmer is a device for skimming floating debris, such as leaves and dirt, from a swimming pool. The skimmer includes a filter in the form of a generally cylindrical basket, sometimes referred to as a leaf basket, which is placed in a skimmer chamber. The skimmer is usually recessed into the pool deck a short distance from the edge of the pool and is covered by a removable lid, which is usually circular in shape. Water recirculated through the pool passes through the skimmer basket, which catches larger items of debris before they can damage pumps and other pool equipment. Periodically, the skimmer basket must be emptied of debris and replaced in its operative position.

In some applications, the skimmer lid is held in place by screws or other fasteners that require tools for removal. Securing the lid in this manner renders it more tamper proof, but less convenient to remove for routine maintenance. In many residential pool applications, the skimmer lid is held in place only by gravity and a snug fit with a skimmer collar, and is removable without tools. Typically, skimmer lids have a central finger hole that allows the lid to be lifted from the skimmer for access to the basket. However, when such a lid is reinstalled a number of conditions can create a hazardous situation for pool users. First, improper installation may pose a significant danger to persons using the pool area. A person might trip over a loose skimmer lid, or stumble into the skimmer opening. Another problem is that wave action in the pool can remove the skimmer lid, even if properly installed, leaving the skimmer exposed and posing a more serious hazard. Even wind action can remove a skimmer lid if it is improperly installed or not secured by screws or other fasteners.

It will be appreciated from the foregoing that there is still a need for improvement in the construction of pool skimmer lids. Ideally, what is needed is a skimmer lid that is adequately secured to prevent inadvertent removal by wave action, wind action or normal foot traffic, but which may be easily and conveniently removed for maintenance without tools. The present invention fulfills this need.

SUMMARY OF THE INVENTION

The present invention resides in a skimmer lid that includes at least one integral latch to retain the lid in an installed position, but to permit manual release and removal of the lid without the need for tools. Briefly, and in general terms, the skimmer lid of the invention comprises a structure having an upper face and a lower face, and including integral support ribs. The lid also has a peripheral wall, or a portion of a wall, depending from the lower face and positioned near the outer periphery of the structure, and at least one manually operated latch attached to the lower face of the structure, the latch having a bendable member positioned to engage a skimmer collar opening when the lid is being installed and to prevent inadvertent removal of the lid once the lid is installed. The lid also includes means for manually accessing the bendable member of the latch when the lid is in an installed position, to effect manual removal of the lid without tools.

More specifically, the means for manually accessing the bendable member of the latch includes an opening through the lid structure. The bendable member of the latch includes a first portion extending generally downward from the lower face of the lid structure; a second portion integral with the first portion and extending inward and generally parallel with the lower face of the lid structure; a third portion integral with the second portion and extending upward back toward the lower face of the lid structure; and a camming shoulder integral with the first portion. The camming shoulder engages the skimmer collar as the lid is installed, and bends the latch inward to allow the camming shoulder to clear the collar. Then the bendable member snaps back to latch the lid in place when the camming shoulder clears the skimming collar.

In the illustrative embodiment of the invention, the latch is released by applying a force to the bendable member, and simultaneously lifting the lid. In the preferred embodiment, the lid includes two similar latches positioned diametrically opposite each other on the lid structure, and two corresponding finger openings for accessing and releasing the latches without tools.

It will be appreciated from the foregoing the present invention represents a significant advance in pool skimmer equipment. The invention provides a skimmer lid that can be easily installed and removed without tools, but which eliminates the hazards previously associated with manually removable skimmer lids. Other aspects and advantages of the invention will become apparent from the following more detailed description, considered in relation to the drawings.

DESCRIPTION OF THE PREFERRED EMBODIMENT

Figure 1:
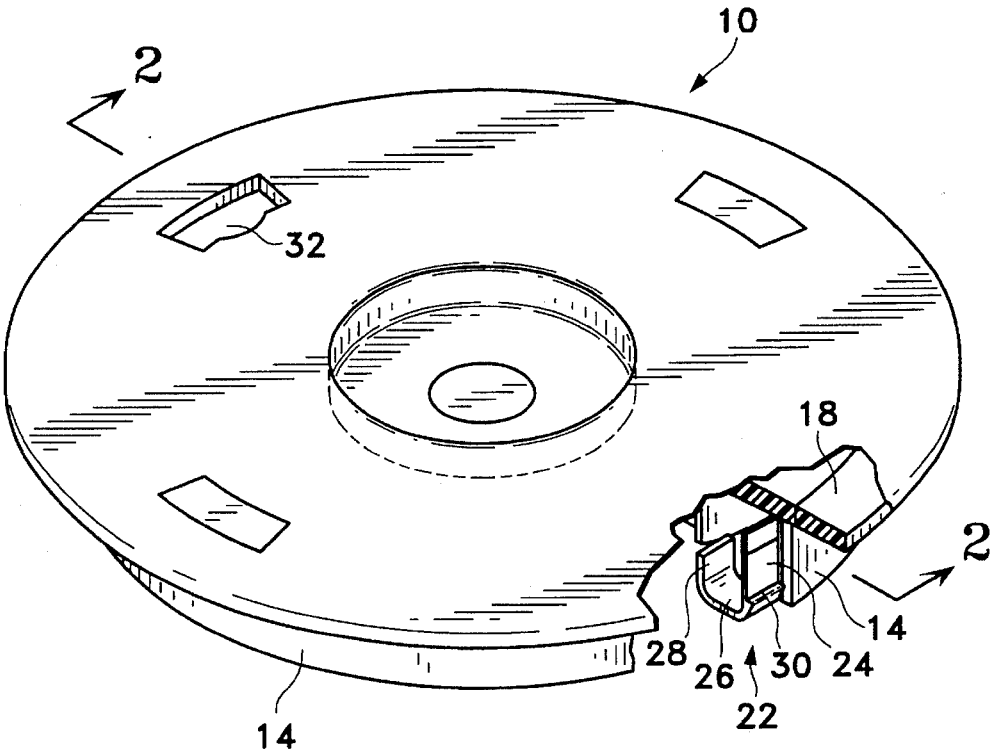
FIG. 1 is a perspective view of a skimmer lid in accordance with the present invention, with a portion of the lid broken away to show a latch structure.

As shown in the drawings for purposes of illustration, the present invention pertains to an improved pool skimmer lid construction having a latching mechanism that will hold the lid in place securely during wave or wind action, but which can be easily removed by finger-tip deactivation of the latching mechanism.

Figure 2:
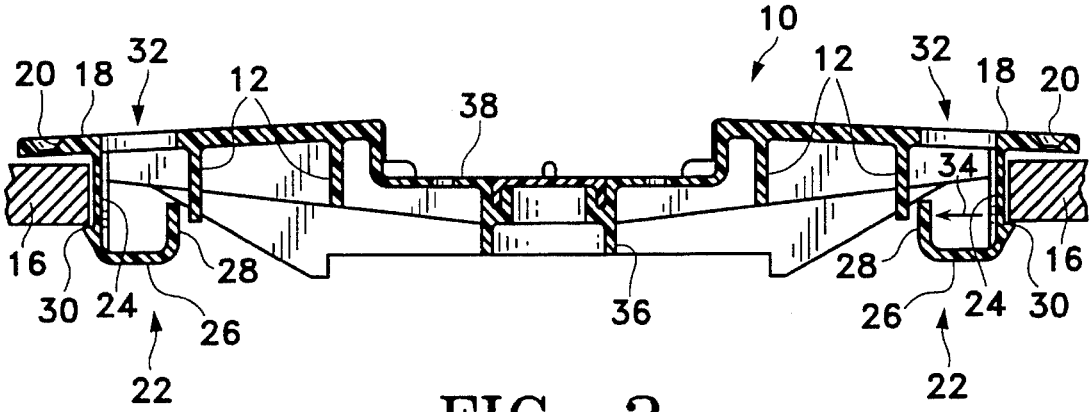
FIG. 2 is an enlarged cross-sectional view of the lid of FIG. 1, taken substantially along the line 2—2 in FIG. 1.

The pool lid of the invention is a generally circular structure, indicated generally by reference numeral 10, preferably formed as a single plastic molding having a number of integral structural support ribs, such as the circular beams 12 formed on the underside of the lid. Near its outer periphery, the lid 10 has an integral downwardly depending wall 14, the external diameter of which is selected to fit the internal diameter of a skimmer housing collar, part of which is shown at 16 in FIG. 2. An outer flange 18 on the lid 10 extends over the housing 16 and may include screw holes 20 for securing the lid by screws, if desired.

In accordance with the invention, the skimmer lid 10 also includes at least one, and preferably two, integral latches 22 formed in openings in the integral wall 14. Each latch 22 is generally U-shaped, having a first portion 24 that is integral with the lid and extends downward from the lid surface, a second portion 26 that extends generally parallel with the lid surface and in a direction away from the outer edge of the lid, and a third portion 28 that extends upward again, parallel with the first portion 24. The first portion 24 of the latch 22 has an integral shoulder 30 formed on its outer surface. The shoulder 30 presents a sloping surface in a downward direction and a flat horizontal surface in an upward direction. Therefore, as the lid 10 is lowered into the collar 16, the sloping surface of the shoulder 30 engages the collar and moves the latch 22 inward in a camming action until the shoulder is completely inside the collar. When the shoulder 30 reaches a position below the collar, the latch snaps back out and the flat horizontal surface of the shoulder 30 engages beneath the collar.

Therefore, the latches 22 prevent inadvertent removal of the lid 10, without the need for screws or other tool operated fastening devices. Unlatching and removal of the lid 10 is facilitated by small openings 32 in the lid. The user places a finger in each of the openings 32 and presses each of the latches inward by contact with the portions 28, as indicated by the arrow 34 in FIG. 2. Each latch 22 is designed such that the downwardly depending portion 24 will bend under manual pressure applied through the opening 32. The latch will also bend inward as the lid 10 is inserted in the skimmer collar 16, and will snap back into its latching position once the shoulder 30 has cleared the collar.

Because the entire latching mechanism is located beneath the surface of the lid 10, a contiguous walking surface is maintained and any potential tripping hazard is eliminated. Moreover, the lid 10 is rigid enough to provide a stable walking surface. In this regard, the lid 10 also includes a circular center support 36 to which integral radial beams are attached for further stability. A central circular well 38 in the upper surface of the lid 10 is used to attach a snap-in center plate for interchangeable accessory and logo information. Another important advantage of the latching mechanism of the invention is that it will fit all collars 16 of various depths without modification.

In brief, the invention provides a skimmer lid that can be safely latched in position without tools, and is equally easy to remove. When latched in position, the skimmer lid of the invention resists removal by wave action, wind action, and inadvertent removal by pool users. Thus the lid of the invention combines safety and ease of use in a structure not previously available in pool skimmer lids. Although a specific embodiment of the invention: has been described in detail for purposes of illustration, various modifications may: be made without departing from the spirit and scope of the invention. Therefore, the invention should not be limited except as by the appended claims.

What is claimed is:

1. A pool skimmer lid for installation in a skimmer collar, the skimmer lid comprising:

a structure having an upper face and a lower face, and including integral support ribs and also including at least a portion of a peripheral wall depending from the lower face and positioned near the outer periphery of the structure;

at least one manually operated latch attached to the lower face of the structure, the latch having a bendable member positioned to engage a skimmer collar opening when the lid is being installed, to prevent inadvertent removal of the lid once the lid is installed; and means for manually accessing the bendable member of the latch when the lid is in an installed position, to effect manual removal of the lid without tools, wherein the means for manually accessing the bendable member of the latch includes an opening through the lid structure.

2. A pool skimmer lid for installation in a skimmer collar, the skimmer lid comprising:

a structure having an upper face and a lower face, and including integral support ribs and also including at least a portion of a peripheral wall depending from the lower face and positioned near the outer periphery of the structure;

at least one manually operated latch attached to the lower face of the structure, the latch having a bendable member positioned to engage a skimmer collar opening when the lid is being installed, prevent inadvertent removal of the lid once the lid is installed; and means for manually accessing the bendable member of the latch when the lid is in an installed position, to effect manual removal of the lid without tools;

and wherein the bendable member of the latch includes a first portion extending generally downward from the lower face of the lid structure;

a second portion integral with the first portion and extending inward and generally parallel with the lower face of the lid structure;

a third portion integral with the second portion and extending upward back toward the lower face of the lid structure; and a camming shoulder integral with the first portion, wherein the camming shoulder engages the skimmer collar as the lid is installed, and bends the latch inward to allow the camming shoulder to clear the collar, and wherein the bendable member snaps back to latch the lid in place when the camming shoulder has cleared the skimming collar.

3. A pool skimmer lid as defined in claim 2, wherein:

the means for manually accessing the bendable member of the latch includes an opening through the lid structure; and the latch is released by applying a force to the bendable member, and simultaneously lifting the lid.

4. A pool skimmer lid for installation in a skimmer collar, the skimmer lid comprising:

a structure having an upper face and a lower face, and including integral support ribs and also including at least a portion of a peripheral wall depending from the lower face and positioned near the outer periphery of the structure;

two similar manually operated latches positioned diametrically opposite each other on the lid structure and attached to the lower face of the structure, the latches each having a bendable member positioned to engage a skimmer collar opening when the lid is being installed, to prevent inadvertent removal of the lid once the lid is installed; and means for manually accessing the bendable member of each latch when the lid is in an installed position, to effect manual removal of the lid without tools, including two corresponding openings for accessing and releasing the latches without tools.

* * * * *